US010741017B2

(12) United States Patent
Silva

(10) Patent No.: US 10,741,017 B2
(45) Date of Patent: Aug. 11, 2020

(54) GAMING SYSTEM FOR VALIDATING DIGITAL LEDGERS

(71) Applicant: IGT, Las Vegas, NV (US)

(72) Inventor: Robert Silva, Reno, NV (US)

(73) Assignee: IGT, Las Vegas, NV (US)

( * ) Notice: Subject to any disclaimer, the term of this patent is extended or adjusted under 35 U.S.C. 154(b) by 40 days.

(21) Appl. No.: 16/234,141

(22) Filed: Dec. 27, 2018

(65) Prior Publication Data

US 2020/0211324 A1 Jul. 2, 2020

(51) Int. Cl.
*G07F 17/32* (2006.01)

(52) U.S. Cl.
CPC ..... *G07F 17/3234* (2013.01); *G07F 17/3223* (2013.01); *G07F 17/3225* (2013.01); *G07F 17/3232* (2013.01); *G07F 17/3241* (2013.01); *G07F 17/3244* (2013.01)

(58) Field of Classification Search
None
See application file for complete search history.

(56) References Cited

U.S. PATENT DOCUMENTS

2014/0121006 A1* 5/2014 Johnson ..... G07F 17/3202 463/25
2015/0348361 A1* 12/2015 Adiraju ..... G07F 17/3213 463/20
2017/0256133 A1* 9/2017 Cooper ..... G07F 17/3244

OTHER PUBLICATIONS

"Cryptocurrency," Wikipedia, last updated Aug. 27, 2018, 19 pages [retrieved online from: en.wikipedia.org/w/index.php?title=Cryptocurrency&oldid=856752813].

* cited by examiner

*Primary Examiner* — Jason T Yen
(74) *Attorney, Agent, or Firm* — Sheridan Ross P.C.

(57) ABSTRACT

A system is disclosed that is capable of validating a selected record of a digital ledger, receiving input that a player has interacted with the gaming system, and, in response to receiving input that the gaming system has interacted with the player, exiting the digital ledger validation mode and entering a game mode in which the gaming system plays a game session with the player.

20 Claims, 8 Drawing Sheets

GAMING SYSTEM FOR VALIDATING DIGITAL LEDGERS

BACKGROUND

The present disclosure is related to gaming systems and devices and, in particular, the use of such devices in connection with validating digital ledgers.

As gaming systems, such as electronic gaming machines (EGMs) and lottery vending machines, offer more features to players, the price of gaming systems has continued to rise. The higher price is commonly not offset by high levels of usage. A typical gaming system has significant idle time between play sessions. These can be extended idle periods, particularly late at night or early in the morning.

BRIEF SUMMARY

In certain embodiments, the present disclosure relates to a gaming system that can validate digital ledgers during idle periods. In some embodiments, a method for digital ledger validation in a gaming system comprises: determining, by a processor, that the gaming system is free of player interaction for a determined period of time; in response to determining that the gaming system is free of player interaction for the determined period of time, causing, by the processor, the gaming system to operate in a digital ledger validation mode to validate a selected record of a digital ledger; receiving, by the processor, input that a player has interacted with the gaming system while the gaming system is in the digital ledger validation mode; and in response to receiving input that the gaming system has interacted with the player, causing, by the processor, the gaming system to operate in a game mode to play a game session.

In some embodiments, a gaming system comprises: a user interface; a processor coupled with the user interface; and a memory coupled with and readable by the processor and storing therein a set of instructions. The set of instructions, when executed by the processor causes the processor to operate in a digital ledger validation mode. When operating in the digital ledger validation mode, the processor validates a selected record of a digital ledger; receives input that a player has interacted with the gaming system; and in response to receiving input that the EGM has interacted with the player, exits the digital ledger validation mode and enters a game mode in which the gaming system plays a game session with the player.

In some embodiments, a server comprises a communications interface that facilitates communications with gaming systems; a processor coupled with the communications interface; and a computer memory coupled with the processor. The computer memory comprises a processor-executable set of instructions that, when executed by the processor, causes the processor to determine that a gaming system is free of player interaction for a determined period of time; in response to determining that the gaming system is free of player interaction for the determined period of time, causes the gaming system, in a digital ledger validation mode, to validate a selected record of a digital ledger; receives input that a player has interacted with the gaming system while the gaming system is in the digital ledger validation mode; and in response to receiving input that the gaming system has interacted with the player, causes the gaming system to exit the digital ledger validation mode and enter a game mode to play a game session with the player.

Additional features and advantages are described herein and will be apparent from the following Description and the figures.

DETAILED DESCRIPTION

Embodiments of the present disclosure will be described in connection with a gaming system having a capability to validate records in a digital ledger during idle periods. While certain embodiments of the present disclosure will reference the use of gaming systems, such as an Electronic Gaming Machine (EGM), lottery vending machine, virtual gaming machine, or video gaming gambling machine (VGM), as a device that validates digital ledger records, it should be appreciated that embodiments of the present disclosure can be used with any computer-controlled gaming device or collection of gaming devices.

Embodiments of the present disclosure will be described in connection with a gaming system that is capable of validating digital ledger records while also being accessible to players for gaming sessions. In some embodiments, the ability to validate digital ledger records during idle periods can not only provide additional revenue through cryptocurrency mining to the owner and thereby decrease capital and operating costs but also more effectively use electrical energy. The dual abilities of the gaming system to earn revenue by playing game sessions and validating digital ledgers can further provide an enhanced gaming experience for players through the more powerful electronics required to effectively and efficiently validate records of digital ledgers.

Figure 1:
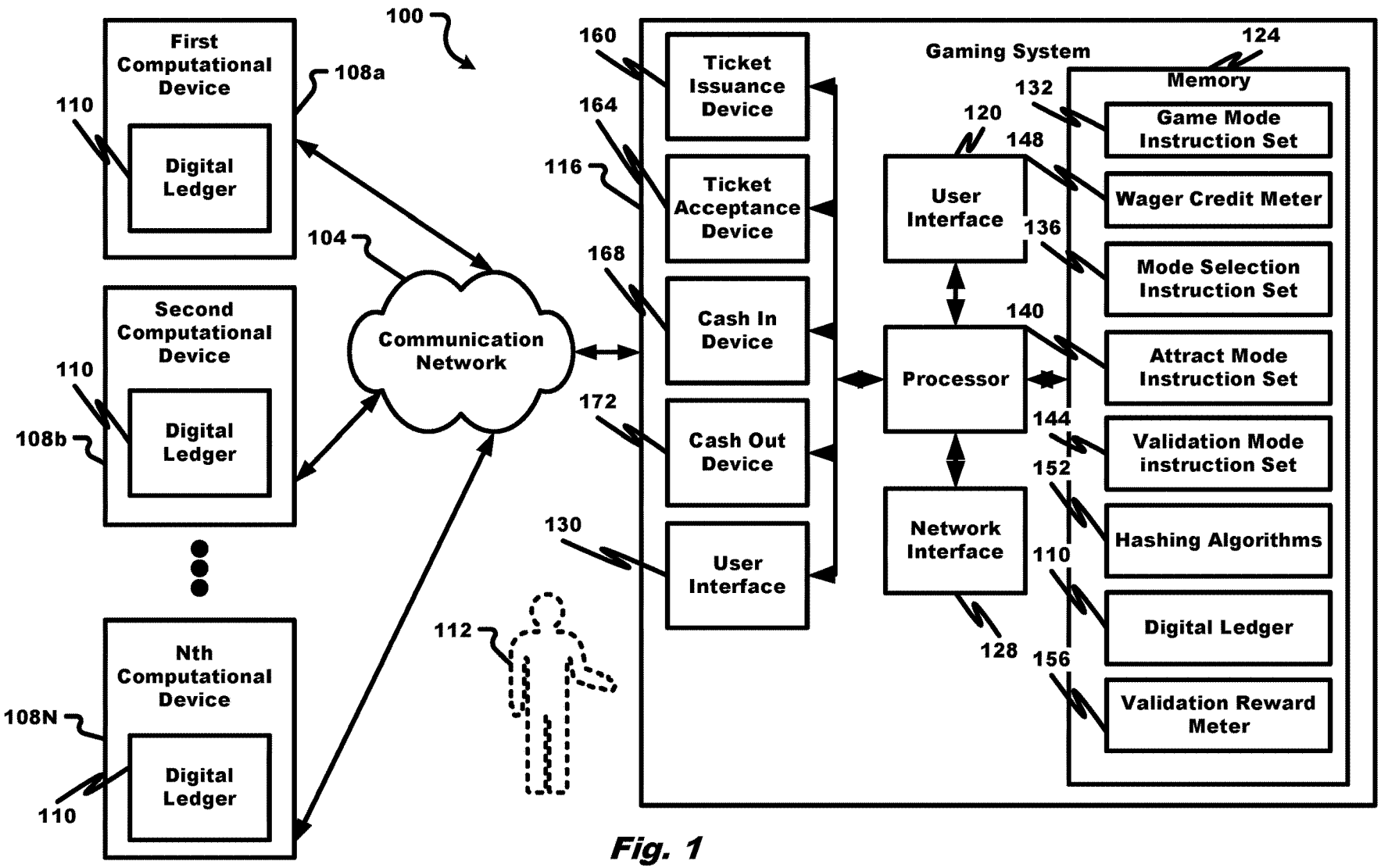
FIG. 1 is a block diagram of a digital ledger validation network in accordance with embodiments of the present disclosure.

With reference initially to FIG. 1, details of an illustrative digital ledger validation network 100 will be described in accordance with at least some embodiments of the present disclosure. The components of the digital ledger validation network 100, while depicted as having particular instruction sets and devices, is not necessarily limited to the examples depicted herein. Rather, a network according to embodiments of the present disclosure may include one, some, or all of the components depicted in the network 100 and does not necessarily have to include all of the components. For instance, the components may be distributed amongst a plurality of servers and/or gaming devices (e.g., an EGM, etc.) without departing from the scope of the present disclosure.

The digital ledger validation network 100 is shown to include a communication network 104 that interconnects and facilitates machine-to-machine communications between one or multiple first, second, . . . nth computational devices 108*a*-N and a gaming system 116. It should be appreciated that the communication network 104 may correspond to one or many communication networks without departing from the scope of the present disclosure. In some embodiments, the various first, second, . . . nth computational devices 108*a*-N and gaming system 116 may be configured to communicate using various nodes or components of the communication network 104. The gaming system 116 can be any single- or multi-player 112 gaming system, such as an EGM, lottery vending machine, VGM, and virtual gaming machine. The communication network 104 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

The first, second, . . . nth computational devices 108*a*-N and gaming system 116 may utilize the same or different types of communication protocols to connect with the communication network 104. Each of the first, second, . . . nth computational devices 108*a*-N and gaming system 116 comprise in memory the digital ledger 110 requiring validation. The first, second, . . . nth computational devices 108*a*-N can be in competition with one another and with the gaming system 116 to earn monetary or crypto-currency awards for being the first to successfully perform certain mathematical operations required for record validation. For example, each of the first, second, . . . nth computational devices 108*a-n* can be crypto-currency miners and the digital ledger can be an open distributed ledger, typically a blockchain, that can record transactions between two parties efficiently and in a verifiable and permanent way. Commonly, the first, second, . . . nth computational devices 108*a-n* and gaming system 116 are part of a peer-to-peer network collectively adhering to a common protocol for validating new records, or blocks. Once recorded, the data in any given record cannot be altered retroactively without the alteration of all subsequent records.

The gaming system 116 is further shown to include a processor 120, memory 124, a network interface 128, and graphical user interface 130. These resources may enable functionality of the gaming system 116 as will be described herein. For instance, the network interface 128 provides the server 116 with the ability to send and receive communication packets or the like over the communication network 104. The network interface 128 may be provided as a network interface card (NIC), a network port, drivers for the same, and the like. Communications between the components of the gaming system 116 and other devices connected to the communication network 104 may all flow through the network interface 128.

The processor 120 may correspond to one or many computer processing devices. For instance, the processor 120 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 120 may be provided as a microprocessor, Central Processing Unit (CPU), or plurality of microprocessors that are configured to execute the instructions sets stored in memory 124. Upon executing the instruction sets stored in memory 124, the processor 120 enables various validation functions of the gaming system 116.

The user interface 130 can be any device enabling a player 112 to interact with the processor 120. The device can include physical input hardware such a keyboard, mouse, or game controls and output hardware such as a computer monitor and speakers. The user interface 130 is commonly a composite user interfaces (CUT) that interacts with two or more senses of the player 112. The most common CUI is a graphical user interface (GUI), which comprises a tactile user interface and a visual user interface capable of displaying graphics. Sound can be added to the GUI to provide a multimedia user interface (MUI).

The memory 124 may include any type of computer memory device or collection of computer memory devices. Non-limiting examples of memory 124 include Random Access Memory (RAM), Read Only Memory (ROM), flash memory, Electronically-Erasable Programmable ROM (EEPROM), Dynamic RAM (DRAM), etc. The memory 124 may be configured to store the instruction sets depicted in addition to temporarily storing data for the processor 120 to execute various types of routines or functions. Although not depicted, the memory 124 may include instructions that enable the processor 120 to select and operate in the digital ledger validation, attract, and game modes.

The illustrative instruction sets that may be stored in memory 124 include, without limitation, a game mode instruction set 132, a mode selection instruction set 136, an attract mode instruction set 140, and a validation mode instruction set 144. Functions of the gaming system 116 enabled by these various instruction sets will be described in further detail herein. It should be appreciated that the instruction sets depicted in FIG. 1 may be combined (partially or completely) with other instruction sets or may be further separated into additional and different instruction sets, depending upon configuration preferences for the gaming system 116. Said another way, the particular instruction sets depicted in FIG. 1 should not be construed as limiting embodiments described herein.

The memory 124 can also include a wager credit meter 148. The wager credit meter 148 may correspond to a secure instruction set and/or data structure within the gaming system 116 that facilitates a tracking of activity at the gaming system 116. In some embodiments, the wager credit meter 148 may be used to store or log information related to various player 112 activities and events that occur at the gaming system 116. The types of information that may be maintained in the wager credit meter 148 include, without limitation, player information, available credit information, wager amount information, and other types of information that may or may not need to be recorded for purposes of accounting for wagers placed at the gaming system 116 and payouts made for a player 112 during a game of chance or skill played at the gaming system 116. In some embodiments, the wager credit meter 148 may be configured to track coin in activity, coin out activity, coin drop activity, jackpot paid activity, bonus paid activity, credits applied activity, external bonus payout activity, ticket/voucher in activity, ticket/voucher out activity, timing of events that occur at the gaming system 116, and the like. In some embodiments, certain portions of the wager credit meter 148 may be updated in response to outcomes of a game of chance or skill played at the gaming system 116. In some embodiments, the gaming system 116 does not include a wager credit meter 148. Exemplary gaming systems include lottery machines, such as lottery vending machines, an EGM, a VGM, and a virtual gaming machine.

The memory 124 can also include not only the digital ledger 110 but also hashing algorithms 152 to be employed in digital ledger validation and a validation reward meter 156. The hashing algorithms 152 can be a proof-of-work scheme, such as a scheme based on SHA-256, scrypt, CryptoNight, Blake, SHA-3, or X11, a proof-of-stake scheme, or a combined proof-of-work and proof-of-stake scheme. Multiple hashing algorithms 152 are commonly maintained in memory 124 as multiple types of digital ledgers may be validated by the gaming system 116. Each hashing algorithm corresponds to a different type of digital ledger. The validation reward meter 156 records crypto-currency awarded to the gaming system 116 for presenting a valid partial proof-of-work and/or proof-of-stake. The validation reward meter 156 can be linked to an operators account to deposit crypto-currency earnings from digital ledger validation activities.

In some embodiments, the game mode instruction set 132, when executed by the processor 120, enables the gaming system 116 to play a game session with a player 112. The game sessions use a random number or pseudorandom number generator to provide computer-generated games. The games can be, for example, slot games, poker games, keno games, bingo games, roulette games, video gambling game, virtual gambling game, and other games of chance.

In some embodiments, the attract mode instruction set 140, when executed by the processor 120, enables the gaming system 116 to display information designed to attract a player 112. In the attract mode, the player 112 is not interacting with the gaming system 116 but the user interface 130 displays a looping gameplay demonstration to attract players. The attract mode is typically triggered by allowing the game to remain a looping gameplay demonstration to attract players. The attract mode is typically triggered by allowing the game to remain on the user interface for an extended period of time. The gaming system can play a short demonstration video to give players an idea of how the game is played and/or display a high score table before returning to the original display. Some gaming systems can provide multiple demonstration videos that are looped through in sequence if the gaming system is left idle.

In some embodiments, the validation mode instruction set 144, when executed by the processor 120, enables the gaming system 116 to validate transaction data in a digital ledger record against a set of validation rules, when the transaction data is successfully validated, execute a hashing algorithm to generate a hash of the transaction data and the hash of the second record in the digital ledger, and save the generated hash in a header of the selected record in the digital ledger. Multiple different validation mode instruction sets, each comprising a set of validation rules, can be stored in memory 124 to validate multiple different types of digital ledgers. By way of example, each validation mode instruction set corresponds to a particular type of cryptocurrency.

In some embodiments, the mode selection instruction set 132, when executed by the processor 120, may enable the gaming system 116 to determine that the gaming system is free of player 112 interaction for a determined period of time, in response cause the gaming system to operate in the digital ledger validation mode to validate a selected record of a digital ledger, receive input that the gaming system has interacted with a potential player 112 while operating in the digital ledger validation mode, and, in response, cause the gaming system to operate in the play mode to play a game session with the player 112. Player 112 interaction can be deemed to have occurred when the player 112 contacts physically the gaming system, the player 112, though not in physical contact with the gaming system, is determined by one or more cameras, motion sensors, microphones, or proximity sensors (such as ultrasonic, capacitive, photoelectric, inductive, or magnetic sensors), to be in spatial proximity to the gaming system 116, and a player credit has been generated by or is otherwise stored in the wager credit meter 148.

Figure 8:
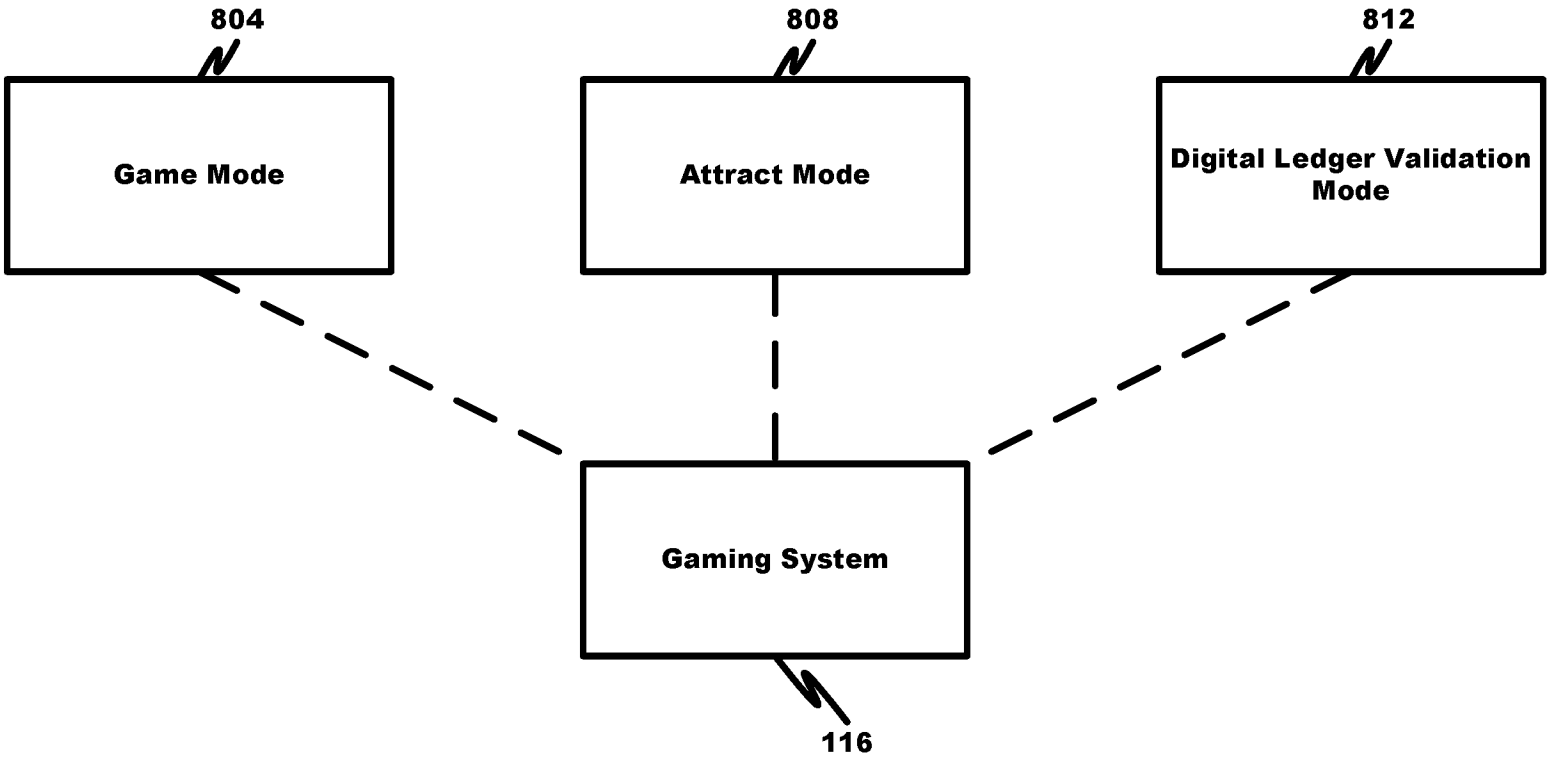
FIG. 8 is a block diagram depicting different gaming system operating modes in accordance with embodiments of the present disclosure.

With reference to FIG. 8, the different operating modes in which the gaming system 116 can operate in are illustrated. The game, attract, and digital ledger validation modes 804, 808, and 812 are commonly temporally discrete from one another and provide, via the user interface 130, different displayed information to the player 112. In the game mode 804, the player 112 interacts actively with the gaming system 116 to play a game session, causing the user interface to provide game information to the player 112. In the attract mode 808, the player 112 does not interact with the gaming system 116 but the user interface 130 provides predetermined information to attract players 112. The attract mode 808 is typically triggered by allowing the game to remain on the user interface 130 for an extended period of time. In the digital ledger validation mode 812, the player 112 does not interact with the gaming system 116 and the user interface 130 can provide the same of different information relative to that information provided in the attract mode 808. The displayed information can be designed to deter players from selecting the gaming system, such as by displaying an out of service message or a blank screen. In the game and attract modes 804 and 808, respectively, the gaming system 116 commonly does not validate digital ledger records.

In some embodiments, the attract and digital ledger validation modes 808 and 812 are combined and implemented as only one mode. This combined mode is commonly implemented when the amount of computational work to exit the combined mode to the game mode 804 will not cause a noticeable delay to the player 112 in transitioning the user interface-provided information to gaming information. The combined mode is generally employed when the block time is relatively short and separate attract and digital ledger validation modes 808 and 812, respectively, when the block time is longer.

Because the gaming system 116 can be used for the acceptance and issuance of tickets/vouchers, the gaming system 116 can be provided with appropriate hardware to facilitate such acceptance and issuance. Specifically, the gaming system 116 may be provided with a ticket acceptance device 160 that is configured to accept or scan physically-printed tickets/vouchers and extract appropriate information therefrom. In some embodiments, the ticket acceptance device 160 may include one or more machine vision devices (e.g., a camera, IR scanner, optical scanner, barcode scanner, etc.), a physical ticket acceptor, a shredder, etc.

A ticket issuance device 164 may be configured to print or provide physical tickets/vouchers to players 112. In some embodiments, the ticket issuance device 164 may be configured to issue a ticket/voucher consistent with an amount of credit available to a player 112, possibly as indicated within the wager credit meter 148.

A cash in device 168 may include a bill acceptor, a coin acceptor, a chip acceptor, or the like. In some embodiments, the cash in device may also include credit card reader hardware and/or software. A cash out device 172, like the ticket issuance device 160, may operate and issue cash, coins, tokens, or chips based on an amount indicated within the wager credit meter 148. In some embodiments, the cash out device 172 may include a coin tray or the like and counting hardware configured to count and distribute an appropriate amount of coins or tokens based on a player's 112 winnings or available credit within the wager credit meter 148.

Figure 2:
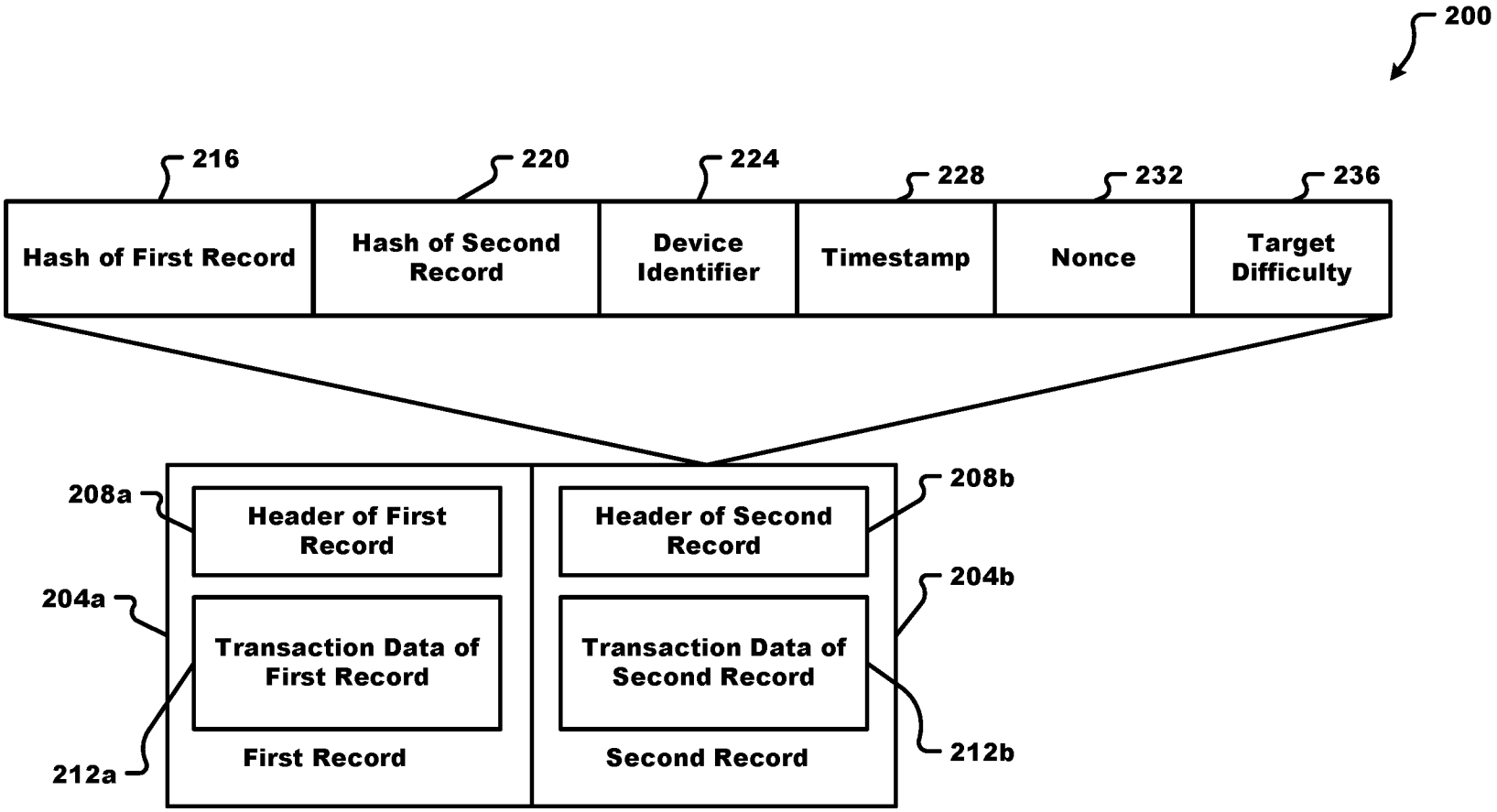
FIG. 2 is a block diagram depicting an illustrative data structure used in a validated record of a digital ledger in accordance with embodiments of the present disclosure.

With reference now to FIG. 2, additional details of the digital ledger will be described in accordance with at least some embodiments of the present disclosure. First and second records 204*a* and *b* of a digital ledger 200 are depicted. Each record comprises a header 208*a* and *b* and transaction data 212*a* and *b*. The header 208*b* of the second record 204*b* can comprise a hash 216 of the first record 216, a hash 220 of the second record 220, a device identifier 224 of the computational device, such as the gaming system 116, adding the second record 204*b* to the digital ledger 200, a timestamp 228, a nonce 232, and a target difficulty 236. The hashes of the first and second records 216 and 220 are generated using a selected hashing algorithm 152. The device identifier 224 can be any unique device identifier, such as a serial number, TCP/IP address, MAC address, or other electronic address of the computational device on the communication network 104. The timestamp 228 is the timestamp when the respective second record was hashed. The target difficulty 236 adjusts up or down depending on how quickly records are added to digital ledgers by the first, second, . . . nth computational devices 108*a-n* and the gaming system 116. In many embodiments, the gaming system 116 must first win a competition with the first, second, . . . nth computational devices 108*a-n* to find the correct hash that solves a difficult math problem. For example, the gaming system 116 can win the competition if it is the first to produce a hash from the selected record with a certain number of leading zeros. The target difficulty can be adjusted after a determined number of records are added by the community of first, second, . . . nth computational devices 108*a-n* and gaming system 116, with the adjustment being based in some embodiments on how long it took to solve mathematical problems presented in the records. The nonce 232 can be a number added to each record and is the variable that the gaming system 116 or first, second, . . . nth computational devices 108*a-n* can continuously change until it finds a nonce that solves the math problem. Stated differently, the gaming system 116 or computational devices 108*a-n* can continuously change the nonce until the hashing algorithm results in a hash with a certain number of leading zeros. When the gaming system or computational device broadcasts the record to the network 104, the other computational devices 108 can use the nonce 232 in a selected record 208 and hash the transaction data 204 in the corresponding record and determine whether or not the nonce produces a hash with the correct number of leading zeros.

The transaction data 212 can be a list of transactions. In some embodiments, the transactions in the record are contained in a merkle tree or binary hash tree structure. Each transaction can be defined by an interaction between two nodes of the network 104. For example, the transaction data 212 can be a list of cryptocurrency transactions in which a user signs off on a transaction from his or her wallet application and causes a crypto or token to be sent to another party's network node. The transaction data can be anonymous by listing specific cryptocurrency addresses rather than a personal name or electronic address of either the user or the party.

Figure 3:
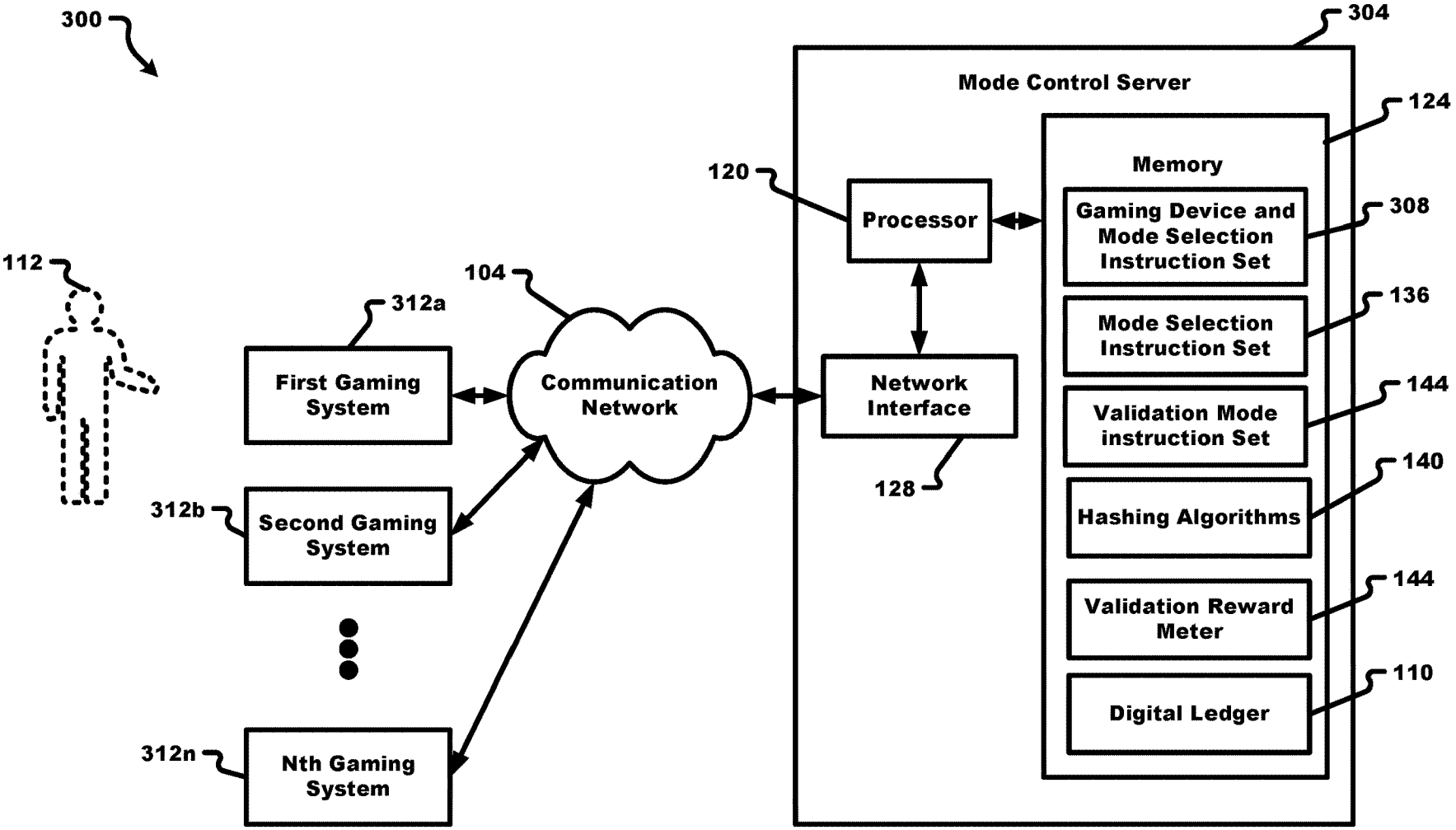
FIG. 3 is a block diagram depicting details of a server-controlled electronic gaming system in accordance with embodiments of the present disclosure.
Figure 4:
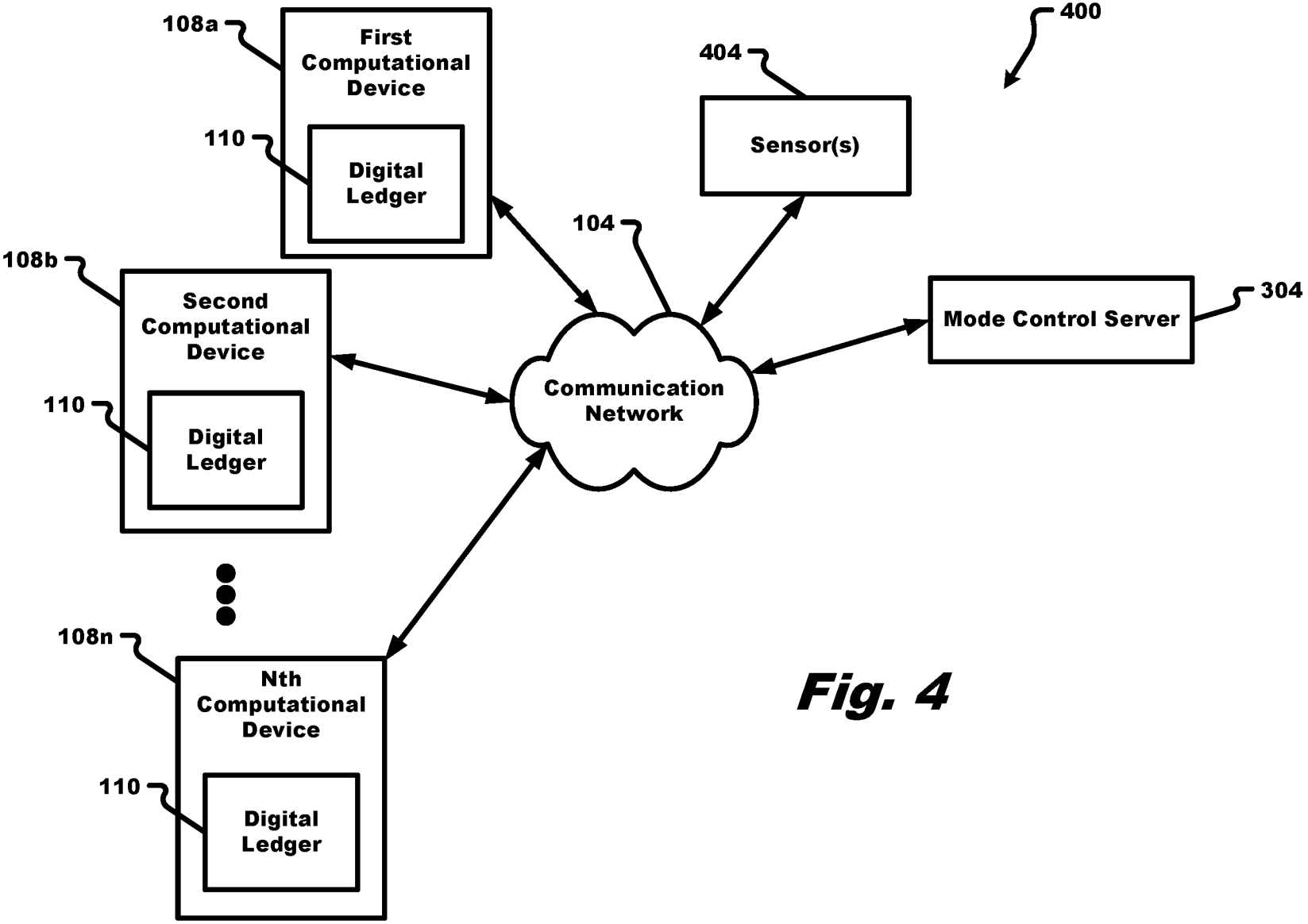
FIG. 4 is a block diagram depicting additional details of the server-controlled digital ledger validation gaming system in accordance with embodiments of the present disclosure.

With reference now to FIGS. 3 and 4, additional details of a server-controlled distributed gaming system 300 will be described in accordance with at least some embodiments of the present disclosure. The distributed gaming system 300 comprises a mode control server 304 in communication, via network 104, with first, second, . . . nth gaming systems 312*a-n*. Each of the gaming systems 312*a-n* may be similar or identical to the gaming system 116 depicted in FIG. 1. By way of illustration, the gaming systems 312*a-n* can be an EGM, lottery vending machine, video game gambling machine, or virtual gaming machine.

With reference to FIG. 4, the mode control server 304 is in communication, via communication network 104, with the first, second, . . . nth computational devices 108*a-n* and one or more sensors 404. As described in more detail below, the sensors 404 collect and provided sensed information to the mode control server 304 to enable more effective control of digital ledger validation operations performed by the first, second, . . . nth gaming systems 312*a-n*.

In some embodiments, the first, second, . . . nth gaming systems 312*a-n* may be distributed throughout a single property or premises (e.g., a single casino floor) or the first, second, . . . nth gaming systems 312*a-n* may be distributed among a plurality of different properties. In a situation where the first, second, . . . nth gaming systems 312*a-n* are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

It should also be appreciated that the first, second, . . . nth gaming systems 312*a-n* may or may not present the same type of game to a player 112. For instance, the first gaming system 312*a* may correspond to a gaming system that presents a slot game to the player 112, the second gaming system 312*b* may correspond to a video poker machine, and other gaming systems may present other types of games or a plurality of different games for selection and eventual play by the player 112. It may be possible for the first, second, . . . nth gaming systems 312*a-n* to communicate with one another via the communication network 104. In some embodiments, one or more of the first, second, . . . nth gaming systems 312*a-n* may only be configured to communicate with a centralized management server and/or the mode control server 304. Although not depicted, the distributed gaming system 300 may include a separate server or collection of servers that are responsible for managing the operation of the various gaming systems 312*a-n*. It should also be appreciated that the mode control server 304 may or may not be co-located with one or more gaming systems 312*a-n* in the same property or premises. Thus, one or more gaming systems 312*a-n* may communicate with the mode control server 304 over a WAN, such as the Internet. In such an event, a tunneling protocol or Virtual Private Network may be established over some of the communication network 104 to ensure that communications between a gaming system 312 and a remotely-located server 304 are secured.

The mode control server 304 is further shown to include a processor 120, memory 124, and a network interface 128. The illustrative instruction sets that may be stored in memory 124 include, without limitation, a gaming device and mode selection instruction set 308, a mode selection instruction set 136, and a validation mode instruction set 144. It should be appreciated that the instruction sets depicted in FIG. 3 may be combined (partially or completely) with other instruction sets or may be further separated into additional and different instruction sets, depending upon configuration preferences for the server 304. Said another way, the particular instruction sets depicted in FIG. 3 should not be construed as limiting embodiments described herein. The memory 124 can also include not only the digital ledger 110 but also hashing algorithms 152 to be employed in digital ledger validation and a validation reward meter 156.

In some embodiments, the gaming device and mode selection instruction set 308, when executed by the processor 120, may enable the mode control server 304 to select a gaming system from among the multiple gaming systems 312*a-n*, determine that the selected gaming system 312*a-n* is eligible to enter the digital ledger validation mode 812, cause the selected gaming system 312 to execute, or itself execute on behalf of the selected gaming system 312, the mode selection instruction set 136, determine the validation mode instruction set 144 from among multiple possible validation mode instruction sets and select the hashing algorithm to be employed by the selected gaming system 312*a-n* in digital ledger validation, and command the selected gaming system 312*a-n* to enter the digital ledger validation mode 812 using the selected validation mode instruction set and hashing algorithm.

In determining whether or not the selected gaming system is eligible for entry into the digital ledger validation mode 812, eligibility can be determined based on one or more factors comprising a whether a current time falls within a predetermined time period or time of day in which digital ledger validation may occur, a current player occupancy of the spatial area occupied by one or more of the first, second, . . . nth gaming systems 312*a-n* is below a determined threshold, a historic player usage of the selected gaming system 312 or a set of the gaming systems 312*a-n* for the current time is below a determined threshold, a current power charge for operating the gaming system 312 is less than a determined threshold, and a number of gaming systems 312*a-n* currently operating in the digital ledger validation mode 812 is at or below a determined threshold.

The sensors 404 can provide information to the mode control server 304 to enable application of one or more of the factors. For example, a clock can provide timing information to determine whether a current time falls within a predetermined time period or time of day in which digital ledger validation may occur or whether a historic player usage of the selected gaming system 312 or a set of the gaming systems 312*a-n* for the current time is below a determined threshold, an occupancy sensor or camera and/or image processing system can provide occupancy information to determine whether a current player occupancy of the spatial area occupied by one or more of the first, second, . . . nth gaming systems 312*a-n* is below a determined threshold, and a smart or automatic meter can provide power charge information to determine whether a current power charge for operating the gaming system 312 is less than a determined threshold.

The mode control server 304 can cause each of the first, second, . . . nth gaming systems 312*a-n* to validate a different selected digital ledger 110 or two or more of the first, second, . . . nth gaming systems 312*a-n* to validate a common selected digital ledger 110. In other words, two or more gaming systems 312*a-n* can execute, substantially concurrently, the same validation mode instruction set 144 with respect to a common digital ledger 110. Operating collectively in parallel to validate a selected digital ledger 110 can increase rewards and revenue from ledger validation. Collective operation can increase the success rate of winning rewards due to greater hashing power being applied to solve the mathematical problem in the selected digital ledger 110.

Figure 5:
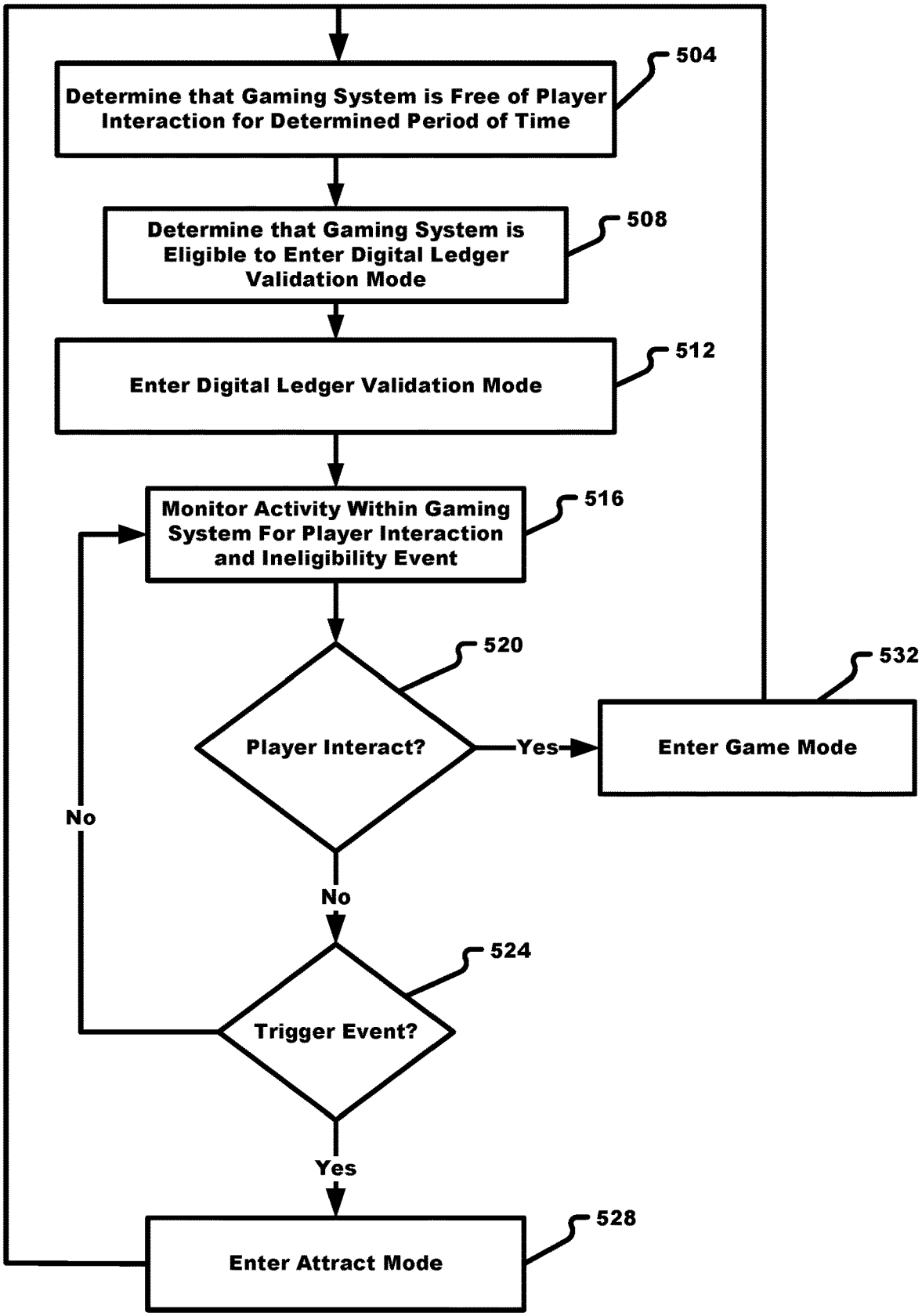
FIG. 5 is a flow diagram depicting a method of invoking and operating in the validation mode in accordance with embodiments of the present disclosure.

With reference now to FIG. 5, a method of operating in the digital ledger validation mode 812 will be described in accordance with embodiments of the present disclosure. In some embodiments, the method corresponds to the operations performed by a processor executing the mode selection instruction set 136.

The method begins with the determination in step 504 that the gaming system 116 and 312 is free of player interaction for a determined period of time. Player 112 interaction can be deemed to have occurred when the player 112 contacts physically the gaming system 116 and 312, the player 112, though not in physical contact with the gaming system 116 and 312, is determined to be in spatial proximity to the gaming system, or a player credit has been generated by or is otherwise stored in the wager credit meter 148.

The method continues by the determination in step 508 that the gaming system 116 and 312 is eligible to enter the digital ledger validation mode 812. Eligibility typically is determined by the gaming system 116 and 312 determining whether a current time falls within a predetermined time period or time of day in which digital ledger validation may occur, a historic player usage of the selected gaming system 312 or a set of the gaming systems 312*a-n* for the current time is below a determined threshold, and a current power charge for operating the gaming system 312 is less than a determined threshold.

After determining that the gaming system 116 and 312 is free of player interaction and eligible to enter the digital ledger validation mode 812, the method continues by entering in step 512 into the digital ledger validation mode 812.

The method continues by monitoring in step 516 the activity within the gaming system 116 and 312 for player interaction or ineligibility event. The ineligibility event occurs when a current time falls outside of a predetermined time period or time of day in which digital ledger validation may occur, a historic player usage of the selected gaming system 312 or a set of the gaming systems 312*a-n* for the current time is above a determined threshold, and a current power charge for operating the gaming system 312 exceeds a determined threshold.

The gaming machine 116 then proceeds to query 520.

If the query 520 is answered positively, then the method continues by the gaming system entering, in step 532, the game mode 804.

If the query 520 is answered negatively, then the method continues by determining in query 524 whether or not the ineligibility event has occurred.

If the query 524 is answered positively, then the method continues by the gaming system entering, in step 528, the attract mode 808.

After entry into either the game mode 804 in step 532 or the attract mode 808 in step 528, the gaming system returns to step 504.

Figure 6:
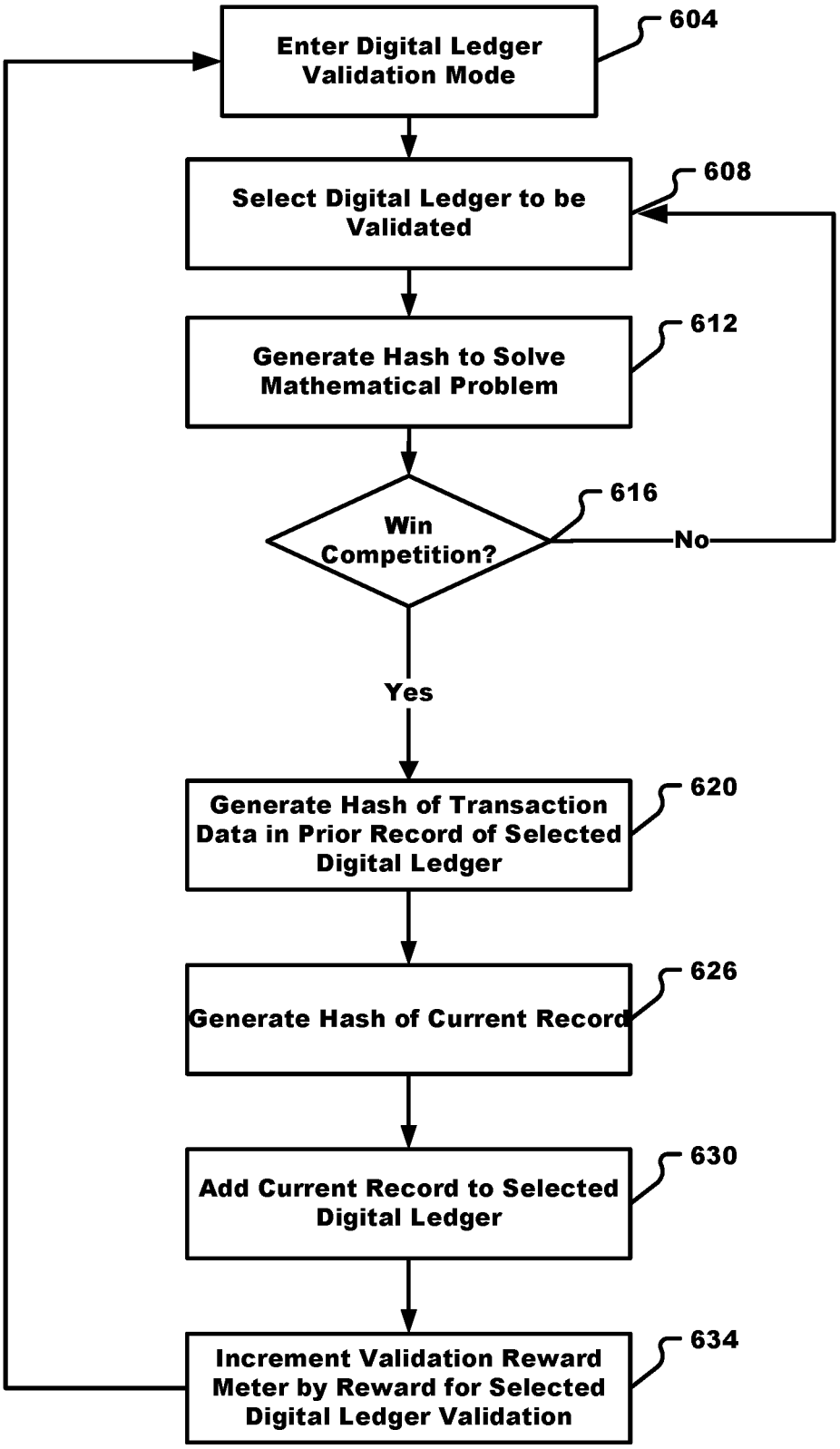
FIG. 6 is a flow diagram depicting a method of validating digital ledgers in accordance with embodiments of the present disclosure.

With reference now to FIG. 6, a method of performing digital ledger validation will be described in accordance with embodiments of the present disclosure. In some embodiments, the method corresponds to the operations performed by a processor executing the validation mode instruction set 144.

The method begins in step 604 when the gaming system 116 or 312 enters the digital ledger validation mode 812.

The method may continue with the gaming system 116 or 312 selecting a digital ledger 110 to be validated (step 608).

The method may continue by the gaming system 116 or 312 selecting a nonce and generating a hash to solve a mathematical problem associated with the selected digital ledger 110 (step 612).

In query 616, the gaming system 116 or 312 determines whether the mathematical problem has already been solved by another computational device. If the query 616 is answered negatively, the gaming system 116 or 312 returns to step 608 and selects a next digital ledger 110 to be validated. If the query is answered positively, the gaming system 116 or 312 generates a hash of the transaction data in a prior record of the selected digital ledger (step 620).

The method continues in step 626 by the gaming system 116 or 312 generating a hash of the current record.

The method continues in step 630 by the gaming system 116 or 312 adding the current record to the selected digital ledger.

The method continues in step 634 by the gaming system 116 or 312 incrementing the validation reward meter 156 by the reward for validating successfully the selected digital ledger.

Figure 7:
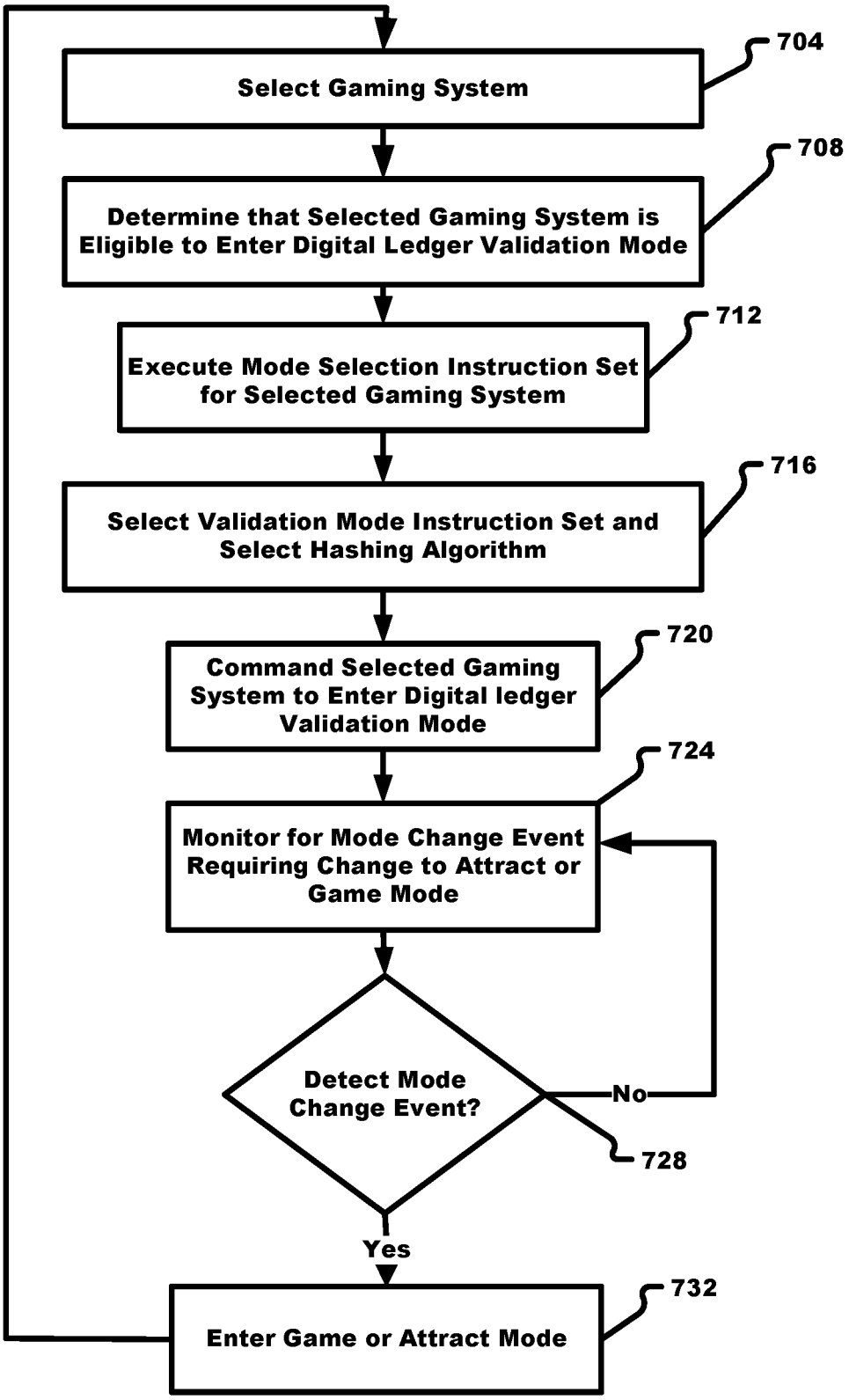
FIG. 7 is a flow diagram depicting a server-controlled method of invoking and operating in the validation mode in accordance with embodiments of the present disclosure.

With reference now to FIG. 7, a method of controlling digital ledger validation operations in multiple gaming systems will be described in accordance with embodiments of the present disclosure. In some embodiments, the method corresponds to the operations performed by a processor of the mode control server 304 executing the gaming device and mode selection instruction set 308.

The method begins in step 704 with the selection of a gaming system 312 from the first, second, . . . nth gaming systems 312*a-n*.

The method continues by the determination (step 708) that the gaming system 116 and 312 is eligible to enter the digital ledger validation mode 812. Eligibility typically is determined by the gaming system 116 and 312 determining whether a current time falls within a predetermined time period or time of day in which digital ledger validation may occur, a current player occupancy of the spatial area occupied by one or more of the first, second, . . . nth gaming systems 312*a-n* is below a determined threshold, a historic player usage of the selected gaming system 312 or a set of the gaming systems 312*a-n* for the current time is below a determined threshold, a current power charge for operating the gaming system 312 is less than a determined threshold, and a number of gaming systems 312*a-n* currently operating in the digital ledger validation mode 812 is at or below a determined threshold. The eligibility criteria applied by the mode control server 304 can be the same or different from those applied in step 508 of FIG. 5.

After determining that the selected gaming system 312 is eligible to enter the digital ledger validation mode 812, the method continues in step 712 by the mode control server 304 causing the gaming system 312 to execute the mode selection instruction set 136.

The method continues in step 716 by the mode control server selecting the validation mode instruction set 144 from among multiple validation mode instruction sets 144 for the selected gaming system 312 and digital ledger 110.

The method continues in step 720 by the mode control server commanding the selected gaming system to enter the digital ledger validation mode 812 with respect to the selected digital ledger 110 by executing the selected validation mode instruction set and hashing algorithm.

The mode control server then proceeds to step 724 and monitors for a mode change event requiring a change from the digital ledger validation mode 812 to the attract or game modes 808 or 804, respectively. The mode change event can be a determination by the mode control server that a current time falls outside of a predetermined time period or time of day in which digital ledger validation may occur, that a current player occupancy of the spatial area occupied by one or more of the first, second, . . . nth gaming systems 312*a-n* exceeds a determined threshold, that a historic player usage of the selected gaming system 312 or a set of the gaming systems 312*a-n* for the current time exceeds a determined threshold, or that a current power charge for operating the gaming system 312 exceeds a determined threshold. Alternatively, such an event can be a notification from the selected gaming system that the gaming system is not free of player interaction (step 504 of FIG. 5) or the occurrence of an ineligibility trigger event (step 516 of FIG. 5).

In query 728, the mode control server 304 determines whether or not a mode change event has been detected.

If query 728 is answered positively, then the method continues by the mode control server causing the selected gaming system 312 I step 732 to enter the game or attract mode, as appropriate.

If the query 728 is answered negatively, the mode control server returns to step 724.

It should be appreciated that the various methods and systems described herein may be attractive to casinos because the bonus aggregation can be used to increase player loyalty by providing players with an opportunity to win larger awards based on the player's bonus award history. The methods and systems disclosed herein are attractive to players because the players are given more and different opportunities to win aggregated bonuses of various sizes, which may depend upon probabilities of events occurring within a gaming system or game of chance.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, RAM, ROM, EEPROM or Flash memory, an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A method for digital ledger validation in a gaming system, comprising:

determining, by a processor, that a gaming system is free of player interaction for a determined period of time;

in response to determining that the gaming system is free of player interaction for the determined period of time, causing, by the processor, the gaming system to operate in a digital ledger validation mode to validate a selected record of a digital ledger;

receiving, by the processor, input that a player has interacted with the gaming system while the gaming system is in the digital ledger validation mode; and in response to receiving input that the gaming system has interacted with the player, causing, by the processor, the gaming system to operate in a game mode to play a game session with the player.

2. The method of claim 1, wherein the gaming system comprises an electronic gaming machine (EGM), wherein the input comprises the player contacting physically the EGM, wherein the digital ledger is an open distributed ledger, and wherein the selected record in the digital ledger comprises transaction data and a hash of a second record in the digital ledger.

3. The method of claim 2, wherein the processor is located in the EGM and further comprising, in the digital ledger validation mode:

validating, by the processor, the transaction data against a set of validation rules;

when the transaction data is successfully validated, executing, by the processor, a hashing algorithm to generate a hash of the transaction data and the hash of the second record in the digital ledger; and saving, by the processor, the generated hash in a header of the selected record in the digital ledger, wherein, after successful validation, the selected record in the digital ledger comprises (a) the header comprising the generated hash, the hash of the second record in the digital ledger, a nonce, a target difficulty, a device identifier associated with the EGM, and a timestamp of when the selected record in the digital ledger was hashed and (b) the transaction data.

4. The method of claim 1, wherein the gaming system comprises a lottery vending machine, wherein the input comprises the player contacting physically the lottery vending machine, wherein the digital ledger is an open distributed ledger, and wherein the selected record in the digital ledger comprises transaction data and a hash of a second record in the digital ledger, wherein the game session has a predetermined outcome, wherein the hashing algorithm is a proof-of-work scheme and further comprising:

conditioning lottery vending machine entry into the digital ledger validation mode on a current time being a determined time-of-day.

5. The method of claim 1, wherein the gaming system comprises an EGM, wherein the hashing algorithm is a proof-of-stake scheme, wherein the input comprises the player being in spatial proximity to the EGM, wherein the game session has a random or pseudorandom outcome, wherein the EGM is free of player interaction in an attract mode, wherein the attract mode and digital ledger validation modes are different, wherein a graphical user display of the EGM, in the attract mode, provides first output, wherein the graphical user display, in the digital ledger validation mode, provides second output and wherein the first and second output are different from each other, and further comprising:

conditioning EGM entry into the digital ledger validation mode on a current player occupancy of a selected spatial area containing the EGM being below a determined threshold.

6. The method of claim 1, wherein the gaming system comprises an EGM, wherein the hashing algorithm is a combined proof-of-work and proof-of-stake scheme, wherein the player interaction is a player credit generated by the EGM, wherein in the game mode, the EGM is free of digital ledger record validation, wherein in the digital ledger validation mode, the EGM is free of player interaction, and further comprising:

conditioning EGM entry into the digital ledger validation mode on a historic player usage of the EGM or set of EGMs including the EGM at a current time being below a determined threshold; and when in the digital ledger validation mode, selecting a set of validation rules from among a plurality of sets of validation rules to execute to enable validation of the selected record in the digital ledger.

7. An electronic gaming system comprising:

a user interface;

a processor coupled with the user interface; and a memory coupled with and readable by the processor and storing therein a set of instructions which, when executed by the processor causes the processor to operate in a digital ledger validation mode and, when operating in the digital ledger validation mode, the processor:

validates a selected record of a digital ledger;

receives input that a player has interacted with the electronic gaming system; and in response to receiving input that the electronic gaming system has interacted with the player, exits the digital ledger validation mode and enters a game mode in which the electronic gaming system plays a game session with the player.

8. The electronic gaming system of claim 7, wherein the electronic gaming system comprises an electronic gaming machine (EGM), wherein the set of instructions, when executed by the processor, causes the processor to condition EGM entry into the digital ledger validation mode on a current time being a determined time-of-day and causes the processor to enter the digital ledger validation mode when the processor determines that the EGM is free of player interaction for a determined period of time, and wherein the received player interaction is the player contacting physically the EGM.

9. The electronic gaming system of claim 7, wherein the received player interaction is the player being in spatial proximity to the electronic gaming system, wherein the digital ledger is an open distributed ledger, wherein the selected record in the digital ledger comprises transaction data and a hash of a second record in the digital ledger, wherein the set of instructions, when executed by the processor, causes the processor to condition gaming system entry into the digital ledger validation mode on a historic player usage of the electronic gaming system or set of gaming systems including the electronic gaming system at a current time being below a determined threshold, and wherein the set of instructions, when executed by the processor, causes the processor, while operating in the digital ledger validation mode, to:

validate the transaction data against a set of validation rules;

when the transaction data is successfully validated, execute a hashing algorithm to generate a hash of the transaction data and the hash of the second record in the digital ledger; and add in a block header of the selected record in the digital ledger, wherein, after successful validation, the selected record in the digital ledger comprises (a) the block header comprising the generated hash of the transaction data, the hash of the second record in the digital ledger, a nonce, a target difficulty, a device identifier associated with the electronic gaming system, and a timestamp of when the selected record in the digital ledger was hashed and (b) the transaction data.

10. The electronic gaming system of claim 9, wherein the electronic gaming system comprises a lottery vending machine, wherein the game session has a predetermined outcome and wherein the hashing algorithm is a proof-of-stake scheme.

11. The electronic gaming system of claim 9, wherein the electronic gaming system comprises an electronic gaming machine (EGM), wherein the received player interaction is a player credit generated by the EGM, wherein the hashing algorithm is a proof-of-work scheme, and wherein the set of instructions, when executed by the processor, causes the processor to condition EGM entry into the digital ledger validation mode on a number of EGMs currently operating in the digital ledger validation mode being below a determined threshold.

12. The electronic gaming system of claim 9, wherein the electronic gaming system comprises an electronic gaming machine (EGM), wherein the set of instructions, when executed by the processor, causes the processor to condition EGM entry into the digital ledger validation mode on a current cost or availability of electrical energy being below a determined threshold, wherein the game session has a random or pseudorandom outcome, wherein the EGM is free of player interaction in an attract mode, wherein the attract mode and digital ledger validation modes are different, wherein a graphical user display of the EGM, in the attract mode, provides first output, wherein the graphical user display, in the digital ledger validation mode, provides second output and wherein the first and second outputs are different from each other.

13. The electronic gaming system of claim 9, wherein the electronic gaming system comprises a video game gambling machine (VGM), wherein the set of instructions, when executed by the processor, causes the processor to condition VGM entry into the digital ledger validation mode on a current player occupancy of a selected spatial area containing the VGM being below a determined threshold, wherein the hashing algorithm is a combined proof-of-work and proof-of-stake scheme, wherein in the game mode, the VGM is free of digital ledger record validation, wherein in the digital ledger validation mode, the VGM is free of player interaction, and wherein the set of instructions, when executed by the processor, causes the processor to select a set of validation rules from among a plurality of sets of validation rules to execute to enable validation of the selected record in the digital ledger.

14. A server comprising:

a communications interface that facilitates communications with gaming systems;

a processor coupled with the communications interface; and a computer memory coupled with the processor, the computer memory comprising a processor-executable set of instructions that, when executed by the processor, causes the processor to:

determine that a gaming system is free of player interaction for a determined period of time;

in response to determining that the gaming system is free of player interaction for the determined period of time, cause the gaming system, in a digital ledger validation mode, to validate a selected record of a digital ledger;

receive input that a player has interacted with the gaming system while the gaming system is in the digital ledger validation mode; and in response to receiving input that the gaming system has interacted with the player, cause the gaming system to exit the digital ledger validation mode and enter a game mode to play a game session with the player.

15. The server of claim 14, wherein the gaming system comprises a virtual gaming machine, wherein the received player interaction is the player contacting physically the virtual gaming machine and wherein the set of instructions, when executed by the processor, causes the processor to condition virtual gaming machine entry into the digital ledger validation mode on a current time being a determined time-of-day.

16. The server of claim 14, wherein the gaming system comprises an electronic gaming machine (EGM), wherein the received player interaction is the player being in spatial proximity to the EGM, wherein the digital ledger is an open distributed ledger, wherein the selected record in the digital ledger comprises transaction data and a hash of a second record in the digital ledger, wherein the set of instructions, when executed by the processor, causes the processor to condition EGM entry into the digital ledger validation mode on a historic player usage of the EGM or set of EGMs including the EGM at a current time being below a determined threshold, and wherein the set of instructions, when executed by the processor, causes the processor to:

validate the transaction data against a set of validation rules;

when the transaction data is successfully validated, execute a hashing algorithm to generate a hash of the transaction data and the hash of the second record in the digital ledger; and add the generated hash in a header of the selected record in the digital ledger, wherein, after successful validation, the selected record in the digital ledger comprises (a) the header comprising the generated hash, the hash of the second record in the digital ledger, a nonce, a target difficulty, a device identifier associated with the gaming system, and a timestamp of when the selected record in the digital ledger was hashed and (b) the transaction data.

17. The server of claim 14, wherein the gaming system comprises a lottery vending machine, wherein the game session has a predetermined outcome, and wherein the hashing algorithm is a proof-of-work scheme.

18. The server of claim 16, wherein the received player interaction is a player credit generated by the EGM, wherein the hashing algorithm is a proof-of-work scheme, wherein in the game mode, the EGM is free of digital ledger record validation, wherein in the digital ledger validation mode, the EGM is free of player interaction, and wherein the set of instructions, when executed by the processor, causes the processor to condition EGM entry into the digital ledger validation mode on a number of EGMs currently in the digital ledger validation mode.

19. The server of claim 14, wherein the gaming system comprises a virtual gaming machine, wherein the set of instructions, when executed by the processor, causes the processor to condition virtual gaming machine entry into the digital ledger validation mode on a current cost or availability of electrical energy being below a determined threshold, wherein the game session has a random or pseudorandom outcome, wherein the virtual gaming machine is free of player interaction in an attract mode, wherein the attract mode and digital ledger validation modes are different, wherein a graphical user display of the virtual gaming machine, in the attract mode, provides first output, wherein the graphical user display, in the digital ledger validation mode, provides second output, and wherein the first and second outputs are substantially the same.

20. The server of claim 16, wherein the set of instructions, when executed by the processor, causes the processor to condition EGM entry into the digital ledger validation mode on a current player occupancy of a selected spatial area containing the EGM being below a determined threshold, wherein the hashing algorithm is a combined proof-of-work and proof-of-stake scheme, and wherein the set of instructions, when executed by the processor, causes the processor to select a set of validation rules from among a plurality of sets of validation rules to execute to enable validation of the selected record in the digital ledger.

* * * * *